US007159353B1

(12) United States Patent
Adams

(10) Patent No.: US 7,159,353 B1
(45) Date of Patent: Jan. 9, 2007

(54) SHOTGUN FIREARM

(75) Inventor: William E. Adams, Portersville, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 11/225,554

(22) Filed: Sep. 13, 2005

(51) Int. Cl.
*F41A 3/00* (2006.01)

(52) U.S. Cl. ..... 42/42.01; 42/76.01; 89/14.05

(58) Field of Classification Search ..... 42/79, 42/76.01; 89/14.8, 14.05
See application file for complete search history.

(56) References Cited

U.S. PATENT DOCUMENTS 198,333 A 12/1877 Baker
441,389 A 11/1890 Brooks
1,227,987 A 5/1917 Wright
1,685,673 A 9/1928 Jones
1,902,702 A 3/1933 Jenkins
4,182,064 A 1/1980 Martensson
4,481,861 A 11/1984 Rodriguez et al.
4,712,323 A 12/1987 Masina

*Primary Examiner*—Stephen M. Johnson
*Assistant Examiner*—Gabriel J. Klein
(74) *Attorney, Agent, or Firm*—Buchanan Ingersoll & Rooney PC

(57) ABSTRACT

A shotgun has two or more firing chambers, each chamber having an exit opening, and a single barrel. A transition connects the exit openings of the firing chambers to the barrel. A movable cover is positioned over or adjacent to the exit opening of at least one of the plurality of firing chambers and can be moved to be positioned over the exit opening of another of the firing chambers.

17 Claims, 2 Drawing Sheets

SHOTGUN FIREARM

FIELD OF INVENTION

The invention relates to firearms which have two or more firing chambers.

BACKGROUND OF THE INVENTION

Shotguns having multiple barrels with a firing chamber associated with each barrel are well-known. Examples of shotguns having multiple barrels can be found in U.S. Pat. Nos. 441,389; 1,920,702 and 4,712,323. It is also known to provide a shotgun having two firing chambers and a single barrel. This type of firearm is constructed so that the exit opening from each firing chamber opens into the single barrel. An example of this type of shotgun can be found in U.S. Pat. No. 1,685,673 to Jones. Wright in U.S. Pat. No. 2,727,987 also discloses a gun in which shots from multiple chambers are directed through a single barrel.

In all of the shotguns of the prior art in which multiple firing chambers are connected to a single barrel, all firing chambers are open to the barrel at all times. Consequently, the back pressure exerted by a shell fired from one firing chamber will expand into the other firing chambers. This pressure could damage any shells in the other chamber or chambers.

Prior art shotguns also stow the shells parallel with the barrel. As a result, there is more distortion to the projectile or shot and to the shot string as the shot is propelled forward to ricochet off the outer wall of the forcing chamber and, then again ricochet off the opposite wall of the barrel.

SUMMARY OF THE INVENTION

I provide a shotgun having two or more firing chambers which open into a single bore. I further provide a cover which is movable such that the cover can alternately be placed over all but one of the exit openings of the firing chambers. Consequently, when one chamber is fired the other chambers will be closed.

I provide a firearm in which the unfired shells are mounted at an inward-facing angle, in inward-facing chambers, to reduce distortion of the projectile, shot, or shot string.

I provide a firearm, in this case a shotgun, having two or more firing chambers that are connected by a transition to a single barrel. In this embodiment a movable cover closes all chambers except the chamber to be fired.

Multi-barrel firearms known as "drillings" often incorporate both rifle and shotgun barrels in one firearm. This allows a hunter to carry as many as two rifle barrels and two shotgun barrels into the field in one gun. With this system, one barrel can fire, say, a .41 caliber solid slug straight down the center barrel with no distortion, and one or more .410 shot shells through the angled chamber(s).

Other objects and advantages of the present invention will become apparent from a description of certain present preferred embodiments shown in the drawings.

DESCRIPTION OF THE PREFERRED EMBODIMENTS

Figure 1:
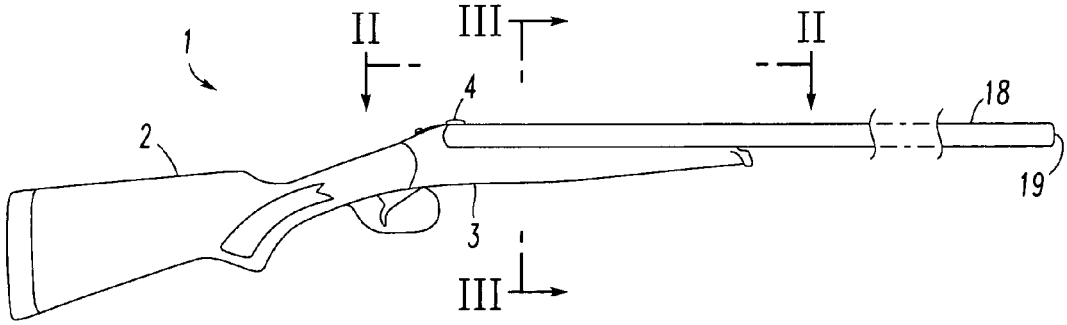
FIG. 1 is a side view of a present preferred embodiment of my shotgun.
Figure 2:
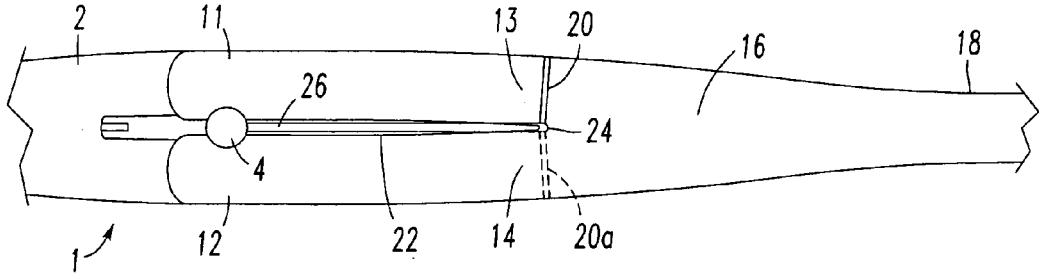
FIG. 2 is a sectional view taken along the line II—II in FIG. 1.

A first present preferred embodiment of my shotgun is shown in FIGS. 1 and 2. This shotgun 1 has a conventional stock 2 to which a breech 3 is attached. The breech contains a firing mechanism having a knob 4 which enables the user to select one of two firing chambers 11, 12. The firing chamber selector may be activated by the trigger, and may be made automatic. The safety is set up in such a way that the blocked chamber will not discharge. The firing chambers each have an opening 13, 14 through which a bullet passes when the gun is fired. A transition portion, forcing cone or merge portion 16 is configured to direct the bullet from either firing chamber into a single barrel 18. Thus, every bullet passes through the same barrel 18 and exits from a single muzzle 19. I further provide a movable cover 20 which is attached to the housing 22 of the shotgun by a hinge 24. A rod 26 extends from the knob 4 to the cover such that selecting a chamber to be fired causes the cover 20 to move over the chamber which is not to be fired. In FIG. 2 the pressure deflecting cover is positioned over firing chamber 11 because firing chamber 12 will be fired. If firing chamber 11 is to be fired the cover would be moved to the position of dotted line 20*a* to block the exit of firing chamber 12. When a shell is fired from the selected chamber the cover prevents back pressure from the fired shell from entering the other chamber. Although I illustrate the cover being attached by a hinge, other configurations which enable the cover to be moved, spun, or rotated into place are possible. For example, the cover could be in a track and slide from side to side. The cover may also operate like a camera lens, opening and enclosing itself in a groove machined around the inside of the end of the firing chamber. A closing mechanism like the valve in an engine choke is also considered appropriate.

The force to close and open the pressure deflector may be provided by springs, similar to those springs that are currently used to activate ejectors, safeties, and firing pins. Such springs are compressed when the shotgun is opened and closed for loading. Force to operate the pressure deflector may also be applied by recoil or gas operated springs, plungers, vanes, gears, and gates.

The force to operate the pressure deflector may also be provided by physically pulling a trigger that has a mechanism with two stages, the first of which closes the unfiring chamber before the second stage of the pull releases the firing pin in the firing chamber. In arms with more than two chambers, all chambers will be blocked except that which is uncovered by the first stage of the trigger pull.

Figure 3:
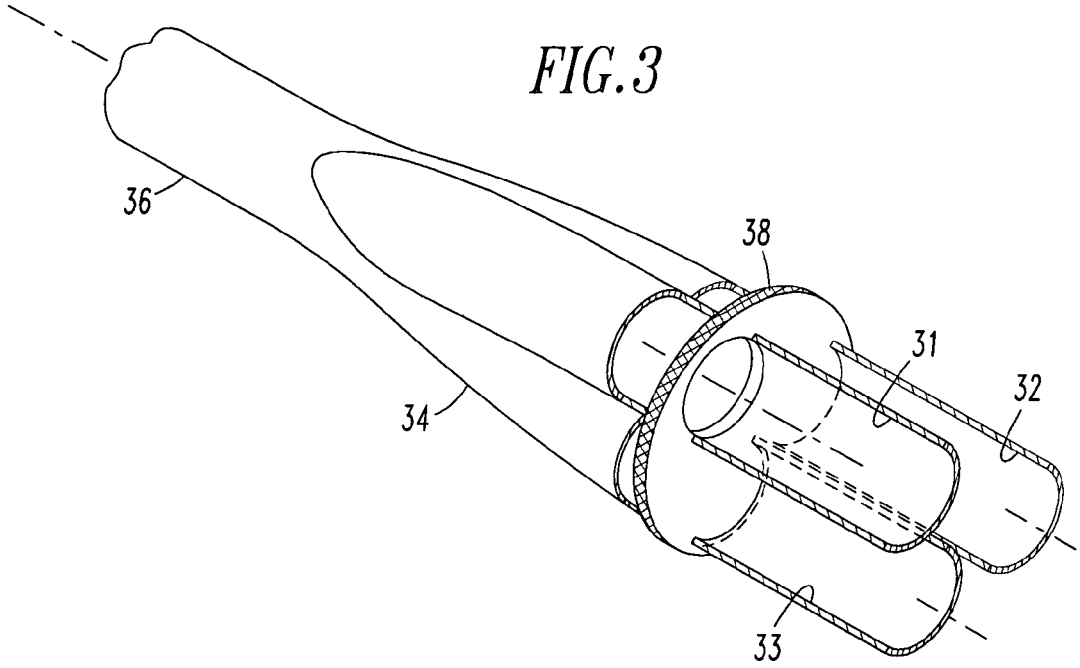
FIG. 3 is a fragmentary view of the firing chamber and transition portion of a second present preferred embodiment of my shotgun.

A second present preferred embodiment illustrated by FIG. 3 is similar to the first embodiment, but has three firing chambers 31, 32 and 33. Three chambers are connected to a transition portion 34 which directs the bullet from any selected chamber to a single barrel 36. In this embodiment the cover 36 rotates about an axis to close any two of the three firing chambers, but a separate cover may be provided for each chamber. A knurled edge portion 38 is provided on the cover. This edge may be a collar that extends back to encircle the firing chambers and enable the user to simultaneously select the firing chamber and correctly position the cover to close the chambers which have not been selected.

Figure 4:
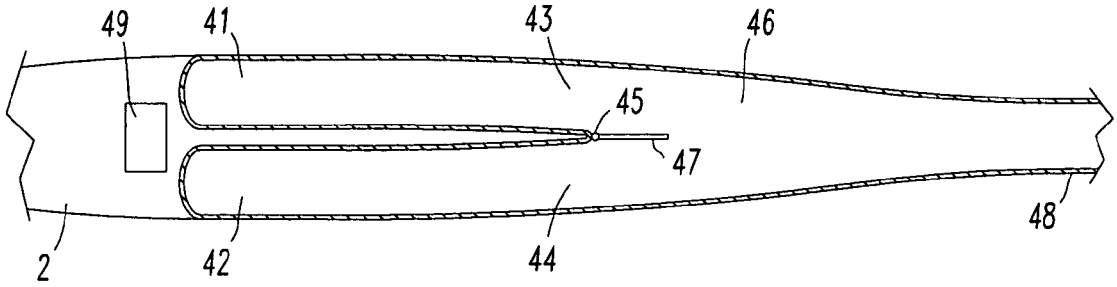
FIG. 4 is a sectional view similar to FIG. 2 of a third present preferred embodiment of my shotgun.

In a third present preferred embodiment shown in FIG. 4 I provide two firing chambers 41, 42 which are similar to the firing chambers 11, 12 of the embodiment shown in FIGS. 1 and 2. The firing chambers each have an opening 43, 44 through which a bullet passes when the gun is fired. A transition portion, forcing cone or merge portion 46 is configured to direct the bullet from either firing chamber into a single barrel 48. In order to eliminate extra mechanical devices in the first embodiment, I provide a gate 47 that extends straight forward toward the forcing cone 46. The gate 47 will block the unfired chamber when the chamber being fired is fired. The gate 47 may be made of either a piece of springy material, like steel, or a pivoting door having a hinge 45 shown in dotted line. When a shell is fired in one of the chambers 41, 42 the expanding gases and moving shot caused by firing the shell moves the gate 47 over the other chamber to protect the unfired shell in that chamber from most, if not all, of the force of the discharge. In some instances, complete blockage is not necessary. When more than two chambers are provided, additional moving blades or gates, usually one less than the number of firing chambers, which operate in the same way are provided. Since these gates will receive a lot of stress, they should be made in a way that lets them be easily replaced. A counter 49 may be provided within the mechanism of the gun that is activated by firing, or provided elsewhere on the firearm that is activated be the user, to keep track of how often the gun had been fired. This counter would indicate the time for replacement of the gate or gates.

While most commonly envisioned for sporting shotguns, such a system could also be adapted for many other firearms where mechanical reliability and weight reduction are of paramount importance. It is particularly useful for situations, as in skeet shooting and sporting clays, where weight reduction is important, especially for older shooters and the growing number of handicapped shooters.

Expert shooters prefer to use double barreled guns because of their superior, almost fool-proof, mechanical reliability, but may shooters don't want to, or are unable to, carry the extra weight of an entire second barrel, especially for a long day in the field or at the range.

Having a largely single barrel reduces weight, and eliminates the costly brazing, attaching, and aligning operation currently necessary with conventional multi-barrel shotguns, whose multiple barrels must be carefully aligned so that both barrels hit at the same place at a desired, and inflexible, distance.

The single barrel also affords an uninterrupted sight plane, as does the over-under shotgun, but without the extra barrel weight.

It is obvious that there will be extra pressure from projectile or shot against the area of the barrel where the shot is aligned with the sighting plane. That section may be made in such a way that it is replaceable when worn, or plated and may be re-plated with harder surfaces, like chrome.

The width of the scatter pattern of shot fired from a shotgun is directly related to the amount and angles of ricochet of the shot within the barrel. This in turn depends upon the angle of the firing chamber relative to the barrel. In another present embodiment of my shotgun, the angle of the firing chamber relative to the barrel is adjustable. Preferably, the angle of the firing chamber relative to the barrel may be adjusted by as much as ten degrees. The greater the angle, the greater the diameter of the pattern.

If desired, the chambers could be used for different shells. For example, one chamber which is coaxial with a centerline through the barrel may be used to fire a .41 caliber solid slug straight down the center barrel with no distortion and the angled chambers could be used to fire .410 shot shells. One might also create the chambers to have somewhat different diameters.

Although I have described and illustrated certain present preferred embodiments of my shotgun it should be distinctly understood that the invention is not limited thereto, but may be variously embodied within the scope of the following claims.

I claim:

1. A shotgun comprising:

a plurality of firing chambers each chamber having an exit opening;

a single barrel;

a transition connecting the exit openings of the firing chambers to the barrel; and a movable cover positioned over the exit opening of at least one of the plurality of firing chambers and movable to a position over the exit opening of another of the plurality of firing chambers.

2. The shotgun of claim 1 wherein there are two firing chambers.

3. The shotgun of claim 2 also comprising a housing positioned between the two chambers and a hinge attached to the cover and the housing.

4. The shotgun of claim 1 wherein the cover rotates about an axis substantially parallel to the barrel.

5. The shotgun of claim 1 also comprising a selector connected to the first chamber for selecting the chamber to be fired.

6. The shotgun of claim 1 also comprising a connector between the selector and the cover such that when the selector is used to select a firing chamber, the cover is moved to a position over the exit of a non-selected firing chamber.

7. The shotgun of claim 1 wherein at least one of the firing chambers is adjustable relative to a centerline through the barrel.

8. The shotgun of claim 7 wherein the at least one firing chamber can be positioned at selected locations along a 10° arc.

9. The shotgun of claim 1 wherein the plurality of firing chambers is comprised of a center chamber axially aligned with a center axis through the barrel and at least one angled chamber which is not coaxial with the center axis through the barrel.

10. The shotgun of claim 9 wherein the center chamber is sized to fire a solid slug and the at least one angled chamber is sized to fire shot shells.

11. The shotgun of claim 1 wherein at least two of the plurality of firing chambers have different diameters.

12. A shotgun comprising:

a plurality of firing chambers each chamber having an exit opening;

a single barrel;

a transition connecting the exit openings of the firing chambers to the barrel; and a movable gate extending into the transition and positioned adjacent the exit opening of at least one of the plurality of firing chambers such that when a shell is fired in one of the chambers expanding gasses and moving shot caused by firing the shell will cause the gate to move to a position over the exit opening of another of the plurality of firing chambers.

13. The shotgun of claim 12 wherein there are two firing chambers.

14. The shotgun of claim 12 wherein the gate is comprised of spring steel.

15. The shotgun of claim 12 also comprising a hinge to which the gate is attached.

16. The shotgun of claim 1 wherein there are at least three firing chambers and further comprising at least one additional gate extending into the transition and positioned adjacent the exit opening of at least one of the plurality of firing chambers such that when a shell is fired in one of the chambers expanding gasses and moving shot caused by firing the shell will cause the additional gate to move to a position over the exit opening of another of the plurality of firing chambers.

17. The shotgun of claim 12 also comprising a counter connected to a portion of the shotgun for keeping track of how often the shotgun is fired.

* * * * *